United States Patent [19]

Hayashi

[11] Patent Number: 4,979,408

[45] Date of Patent: Dec. 25, 1990

[54] SCREW TIGHTENING DEVICE

[75] Inventor: Youichi Hayashi, Kanagawa, Japan

[73] Assignee: Fuji Photo Film Co., Ltd., Kanagawa, Japan

[21] Appl. No.: 419,368

[22] Filed: Oct. 10, 1989

[30] Foreign Application Priority Data

Oct. 12, 1988 [JP] Japan ..... 63-256410

[51] Int. Cl.[5] ..... B25B 23/159

[52] U.S. Cl. ..... 81/477; 173/12

[58] Field of Search ..... 81/469, 477; 173/12

[56] References Cited

U.S. PATENT DOCUMENTS 4,502,549 3/1985 Hornung et al. ..... 87/477 X
4,535,850 8/1985 Alexander ..... 117/12
4,858,312 8/1989 Van Naarden ..... 81/469 X

FOREIGN PATENT DOCUMENTS 53-54398 5/1978 Japan .
57-144673 9/1982 Japan .

*Primary Examiner*—James G. Smith
*Attorney, Agent, or Firm*—Sughrue, Mion, Zinn, Macpeak & Seas

[57] ABSTRACT

A screw tightening device has a DC motor and a bit which is set to a screw. The DC motor is energized by a driving signal and rotates the bit. A torsion spring coupling is connected between the DC motor and the bit and absorbs an excessive torque produced therebetween. When the driving signal is cut, the motor is reversed under the returning force of the torsion spring coupling. A brake circuit causes a brake current which reduces the speed of the reverse rotation of the motor through the motor.

2 Claims, 2 Drawing Sheets

SCREW TIGHTENING DEVICE

BACKGROUND OF THE INVENTION

1. Field of the Invention

This invention relates to a screw tightening device which automatically tightens a screw to a predetermined torque, and more particularly, to a screw tightening device which has an electric motor for driving a tightening bit and in which the screw can be prevented from being tightened to an excessive torque due to inertia of the motor when the motor is stopped.

2. Description of the Prior Art

There has been known a screw tightening device comprising a DC motor which is connected to a bit by way of a coupling. In such a screw tightening device, the tightening torque is successively detected, and the motor is de-energized a predetermined time after the torque detected reaches a predetermined value. When the rotational speed of the motor is increased, for instance, up to 800 to 2000 rpm in order to improve the working efficiency, the rotational moment of the motor can be as large as 0.2 to 1 $Kg/cm^2$, and the impact of the screw head on the surface of the workpiece increases to such an extent that it can damage the workpiece, particularly when the workpiece is of plastic resin. This problem may probably be solved by a torque clutch which is inserted between the output shaft of the motor and the coupling and releases the excessive torque. However, this approach is disadvantageous in that the screw tightening device becomes complicated in structure and large in size, and adjustment and maintenance of the device becomes troublesome.

Further, there has been known a screw tightening device in which a torsion spring is connected between the DC motor and the bit as the coupling so that the driving force of the motor is absorbed by the torsion spring when the screw head impacts against the workpiece. However, since the torsion spring has a small spring constant in order to effectively absorb the driving force, the torsion spring is largely twisted when the screw head impacts against the workpiece and the motor can be excessively reversed under the returning force of the spring when it is de-energized, which can loosen the screw.

SUMMARY OF THE INVENTION

In view of the foregoing observations and description, the primary object of the present invention is to provide a screw tightening device which can satisfactorily tighten a screw without possibility that an excess torque acts on the screw or the screw is loosened under the returning force of the torsion spring.

In accordance with the present invention, there is provided a screw tightening device comprising a bit which is set to a screw, a DC motor which is energized by a driving signal and rotates the bit, a torsion spring coupling which is connected between the DC motor and the bit and absorbs an excessive torque generated therebetween, and a brake circuit which, when the driving signal is cut, supplies to the motor a brake current which reduces the speed of the reverse rotation of the motor under the returning force of the torsion spring coupling.

With this arrangement, the speed of the motor can be reduced when the motor is reversed under the returning force of the torsion spring coupling and accordingly, the screw cannot be loosened even if the motor is reversed.

DESCRIPTION OF THE PREFERRED EMBODIMENT

Figure 1:
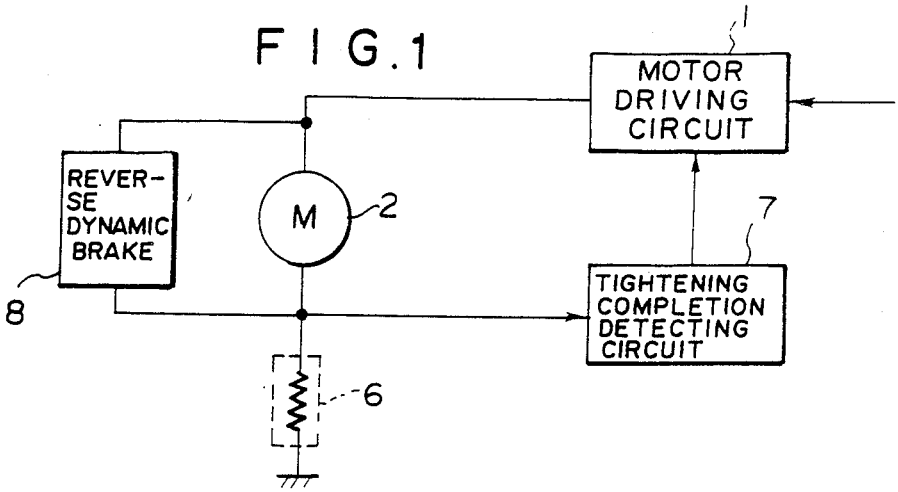
FIG. 1 shows a control circuit of a screw tightening device in accordance with an embodiment of the present invention.
Figure 2:
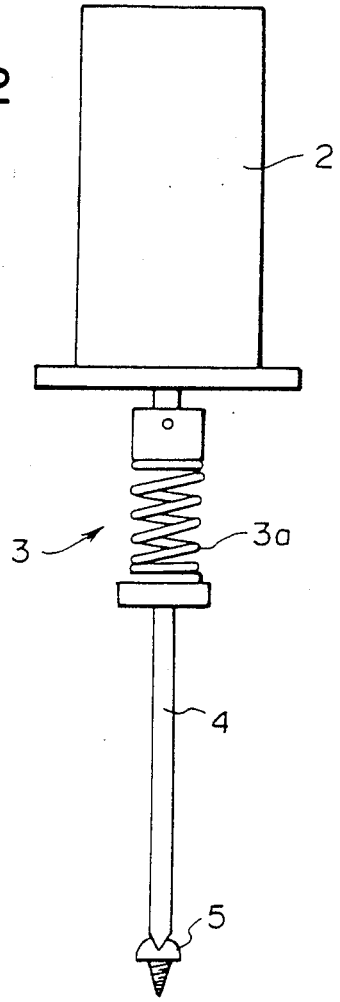
FIG. 2 is a side view of the screw tightening device.

In FIGS. 1 and 2, a motor driving circuit 1 outputs a driving signal of a predetermined voltage and current under the control of a control circuit (not shown), and a DC motor 2 is driven by the driving signal. The rotation of the motor 2 is transmitted to a bit 4 by way of a torsion spring coupling 3 and tightens a screw 5 on a workpiece. The tightening torque of the motor 2 is detected by the current flowing through a current detecting circuit 6, and when the current reaches a predetermined value, a tightening completion detecting circuit 7 outputs a tightening completion signal to the motor driving circuit 1 and causes the circuit 1 to cut the driving signal. A reverse dynamic brake circuit 8 is connected in parallel to the motor 2.

The reverse dynamic brake circuit 8 is turned off when the motor 2 is rotated in the regular direction (the direction in which the screw 5 is tightened), and is turned on when the motor 2 is reversed. The reverse dynamic brake circuit 8 comprises a diode 9 and a limiting resistor 10. The torsion spring coupling 3 includes a torsion spring 3*a*, and transmits the rotating torque from the motor 2 to the bit 4. The torsion spring 3*a* absorbs an excessive torque produced by inertia of the the motor 2. Since the motor 2 has been de-energized when the torsion spring 3*a* absorbs the excessive torque, the torsion spring 3*a* resiliently returns to the original position while reversing the motor 2. The reverse dynamic brake circuit 8 reduces the speed of the reverse rotation of the motor 2 in the following manner.

Figure 3:
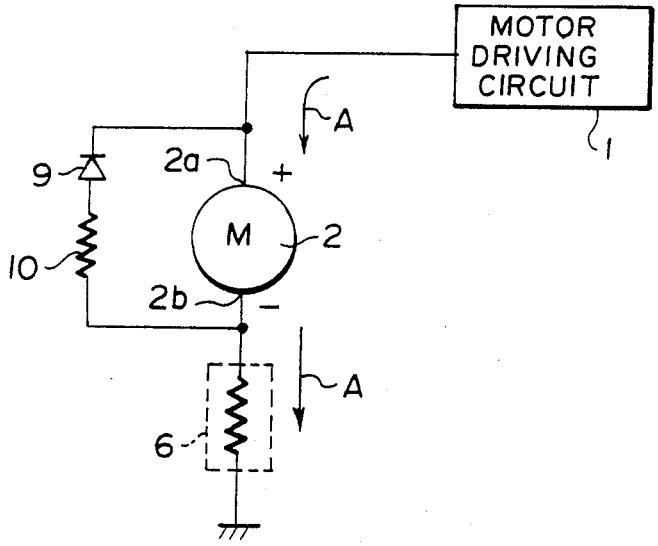
FIGS. 3 and 4 are views for illustrating the operation of the screw tightening device.
Figure 4:
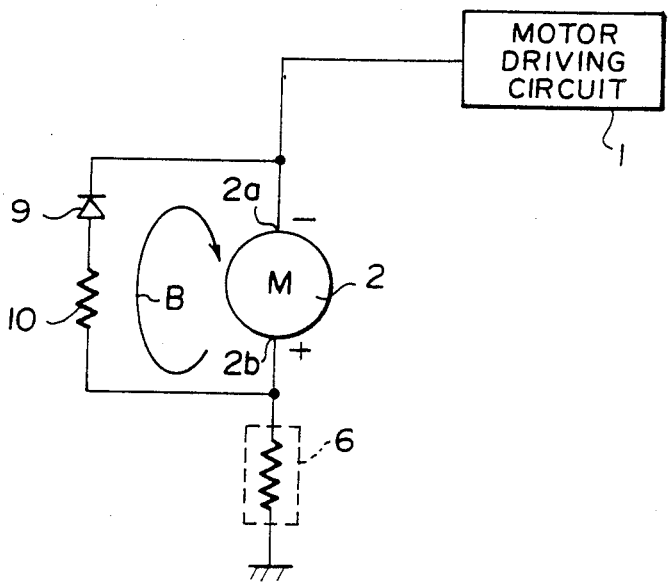

That is, when the screw tightening device tightens the screw 5, the current flows in the direction shown by arrow A in FIG. 3. The direction in which the motor 2 is rotated is referred to as "the regular direction", and reference numerals 2*a* and 2*b* respectively denote terminals of the motor 2. The diode 9 prevents the current from flowing through the reverse dynamic brake circuit 8 when the current flows in the direction of the arrow A. When the driving signal from the motor driving circuit 1 is cut, the motor 2 begins to be reversed under the resiliency of the torsion spring 3*a*. The reverse rotation of the motor 2 produces a positive voltage at the terminal 2*b* and a negative voltage at the terminal 2*a*, whereby a current flows through the reverse dynamic brake circuit 8 in the direction of arrow B as shown by arrow B in FIG. 4. Thus a current which urges the motor 2 in the regular direction flows through the motor 2 and reduces the reverse speed of the motor 2, thereby preventing the motor 2 from overshooting the position corresponding to the position of the torsion spring 3*a* at which it is released from load. If the reverse dynamic brake circuit 8 is not provided, the motor 2 can overshoot the position under its inertia and can loosen the screw 2. The braking force depends on the value of the limiting resistor 10, and the value of the limiting resistor 10 may be zero depending on the braking force requirement.

The reverse dynamic brake circuit 8 need not be limited to that illustrated in FIG. 3. For example, it may be a circuit which flows a small current through the motor 2 in the direction of the arrow A in response to the reverse of the motor 2, or a circuit which short-circuits the terminals 2*a* and 2*b* of the motor 2 by the use of a relay, an SSR or the like when the driving signal is cut.

The spring constant of the torsion spring 3*a* may be determined according to the tightening torque so that it is twisted by 10° to 180° at the maximum tightening torque. The angle by which the torsion spring 3*a* is twisted may be appropriately selected according to the material of the workpiece or the like.

I claim:

1. A screw tightening device comprising:

a bit which is set to a screw, a DC motor which is energized by a driving signal and rotates the bit, a torsion spring coupling which is connected between the DC motor and the bit and absorbs an excessive torque produced therebetween, and a brake circuit which, when the driving signal is cut, supplies to the motor, which has been deenergized, a brake current which reduces the speed of the reverse rotation of the motor under the returning force of the torsion spring coupling, wherein said DC motor is prevented from overshooting a position corresponding to where said torsion spring coupling is released from load.

2. A screw tightening device comprising:

a bit which set to a screw, a DC motor which is energized by a driving signal and rotates the bit, a torsion spring coupling which is connected between the DC motor and the bit and absorbs an excessive torque produced therebetween, and a brake circuit which, when the driving signal is cut, supplies to the motor a brake current which reduces the speed of the reverse rotation of the motor under the returning force of the torsion spring coupling, wherein said brake circuit comprises a diode and a limiting resistor.

* * * * *